United States Patent [19]

Hoffmann

[11] Patent Number: 4,871,090

[45] Date of Patent: Oct. 3, 1989

[54] CARTRIDGE ASSEMBLY FOR FLOWABLE MASSES

[75] Inventor: Armin Hoffmann, Germering, Fed. Rep. of Germany

[73] Assignee: Hilti Aktiengesellschaft, Fürstentum, Liechtenstein

[21] Appl. No.: 222,277

[22] Filed: Jul. 21, 1988

[30] Foreign Application Priority Data

Jul. 30, 1987 [DE] Fed. Rep. of Germany ..... 3725291

[51] Int. Cl.[4] ..... B67B 7/24

[52] U.S. Cl. ..... 222/81; 222/137; 222/145; 222/326; 222/541

[58] Field of Search ..... 222/80–83, 222/85, 88, 94, 541, 135, 137, 145, 326, 327, 391, 501, 505–508, 519, 522

[56] References Cited

U.S. PATENT DOCUMENTS

| | | | |
|---|---|---|---|
| Re. 32,354 | 2/1987 | Savage | 222/81 |
| 1,411,542 | 4/1922 | Van Orsdale | 222/88 X |
| 3,459,190 | 3/1976 | Aguettant et al. | 222/80 X |
| 3,767,085 | 10/1973 | Cannon et al. | 222/82 |
| 4,225,062 | 9/1980 | Sneider | 222/508 X |
| 4,453,651 | 6/1984 | Braithwaite et al. | 222/83 X |
| 4,681,243 | 7/1987 | Takasugi | 222/81 X |

OTHER PUBLICATIONS

Hilti brochure W/1299/1984.

*Primary Examiner*—Kevin P. Shaver
*Attorney, Agent, or Firm*—Toren, McGeady & Associates

[57] ABSTRACT

A cartridge assembly for dispensing flowable masses includes axially extending containers each holding a separate flowable mass and a discharge member for dispensing the flowable masses from the containers. The discharge member and the containers are separate parts assembled into a unit. During storage and transport, the containers are closed and the discharge member is mounted on one end of the containers. When the cartridge assembly is to be used, the unit is inserted into a dispensing device. The discharge member and the containers are displaced relative to one another so that the discharge member moves against one end of the containers for forming openings. The other ends of the containers contain pistons which are pressed by the dispensing device toward the openings in the other ends of the containers forcing the flowable masses into the discharge member from which they are dispensed.

8 Claims, 2 Drawing Sheets

CARTRIDGE ASSEMBLY FOR FLOWABLE MASSES

BACKGROUND OF THE INVENTION

The present invention is directed to a cartridge assembly including one or more containers each holding a flowable mass, and a discharge member. Each container is a hollow cylinder and the discharge member is mounted on one end of the containers and contains conduits for flowing the flowable masses out of the containers.

It is common to store and transport flowable masses in containers. Such containers are usually in the form of a hollow cylinder made of a synthetic plastics material. Since the flowable masses must retain their working characteristics until they are ready to be used, it must be assured during the period of storage and transport that the containers are adequately sealed and that the opening of the container is effected only immediately before the flowable masses are to be used or dispensed.

As an example, time-hardening two-component masses are known, provided in a cartridge arrangement including two containers with a different one of the components being disposed in each of the containers, note the Hilti brochure W/1299/1984. This cartridge arrangement includes a discharge member containing separate discharge conduits connected to the containers. During storage and transport of this cartridge arrangment, the discharge conduits are closed. On the opposite ends of the containers from the discharge member, there are pistons which seal the flowable masses in the containers.

The flowable masses contained in this cartridge arrangement are used in a known dispensing device.

Before the cartridge arrangement is inserted into the dispensing device, the dispensing end of the discharge member is cut off so that the flowable masses can pass through the discharge conduit into a mixing space from which they can be dispensed. The dispensing device includes pressure applicators acting on the pistons in the containers and forcing the pistons toward the discharge member for pressing the flowable masses out of the container into the discharge conduits.

The disadvantage of this known cartridge arrangement is the requirement for cutting off the dispensing opening from the discharge member which is difficult to carry out. If there is no suitable tool available for cutting open the dispensing end, it is possible that the discharge member may be damaged and result in an improper mixing of the reacting components so that the discharged mixture of the components may not be effective.

Furthermore, after the discharge member is cut open, the flowable masses are exposed and may cause substantial contamination of the dispensing device and of the region surrounding the device. In addition, the flowable masses may contact the device operator which requires that protective clothing, such as gloves, be worn, since the flowable masses may be highly reactive materials.

SUMMARY OF THE INVENTION

Therefore, the primary object of the present invention is to provide a cartridge assembly which assures safe storage and transport of the flowable masses and, in addition, provides a clean efficient changeover from the storage and transport condition to the use condition without the requirement of any special tools.

In accordance with the present invention, the cartridge assembly is formed by one or more separate containers and a discharge member which can be connected with and displaced relative to the containers when the assembly is to be used by providing cooperating stop surfaces on the containers and the discharge member. When the flowable mass or masses are to be dispensed, the containers can be opened for flowing the masses into discharge conduits of the discharge member.

In the cartridge assembly of the present invention, each of the containers and the discharge member are completely separate parts. As a result, the containers can be tightly closed or sealed over their entire surface. Each container is in the shape of a hollow cylinder with a closed end from which the flowable mass is to be dispensed, and a piston at the other end for pressing the mass out of the container during use.

The end of the container opposite the piston has a removable closure part. This closure part is removed only when the discharge member moves into a use position relative to the container. Such a position is advantageously attained when stop surfaces on the discharge member and the container are moved into contacting engagement.

The discharge member and the container can be kept as completely separate parts during storage and transport, or the discharge member can be mounted on one or more containers during storage and transport by means of interconnecting members. The discharge member can be constructed so that it can be mounted on one or a number of the containers forming the assembly.

Before the cartridge assembly including the flowable masses are used, the cartridge assembly, in the form of separate parts, or as a preassembled unit, can be inserted into a known dispensing device. Until the separate parts or the unit is placed in the dispensing device, the containers remain closed so that the flowable masses cannot flow out of the container and contact the operator. When the dispensing device is operated, pressure applicators act on the pistons in the containers and the containers are forced at the opposite ends from the pistons against the discharge member. In the storage and transport condition of the unit, the stop surfaces on the discharge member and the containers are in spaced relation, however, as the containers are moved toward the discharge member, the spaced relation is cancelled out and as the stop surfaces contact one another, the removable closures in the ends of the container are opened. If the pressure applicators in the dispensing device continue to force the pistons into the containers, the flowable masses pass out of the containers through the opened closures into the discharge conduits into a mixing unit in the discharge member.

Preferably, the removable closures are located in the center of the containers. To provide a defined separation of the removable closures from the container ends, a suitable annular weakened or reduced cross-section region is provided so that the closures separate easily and evenly from the container ends.

Elongated ejectors are provided on the discharge member facing toward the container ends for effecting the displacement of the closures in the container ends. During storage and transport, the ejectors bear against the displaceable closures with the facing stop surfaces on the discharge member and the containers being in spaced relation. When the cartridge assembly is to be used and the container ends are moved relative to the discharge member with the space between the stop surfaces cancelled out, that is, when the stop surfaces bear against one another, the ejectors press the displaceable closures into the containers. The relative movement between The discharge member and the containers and, as a result, the movement of the ejectors against the displaceable closures, is kept sufficiently large so that the closures can be separated effectively into the containers. Therefore, when the pressure applied by the dispensing device presses the flowable masses out of the containers, the displacement of the closures is such that the openings do not become partly closed again, that is, the closures are completely separated from and displaced out of the openings formed in the ends of the containers.

To assure that the flowable masses do not leak out between the confronting stop surfaces of the containers and the discharge member and contaminate the dispensing device, detent means interconnect the discharge member with the containers when the stop surfaces are in contact and prevent any accidental leakage.

The prevention of any leakage is enhanced by providing tubular sections on the discharge member which enter into the opening formed on the containers and in cooperation with the detent means assure that there is no leakage. To guarantee an adequate sealing effect, the tubular sections have a diameter corresponding approximately to the diameter of the annular weakened section. When the tubular sections are fully inserted into the containers, the detent means interengage and assure the maintenance of the sealing effect.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
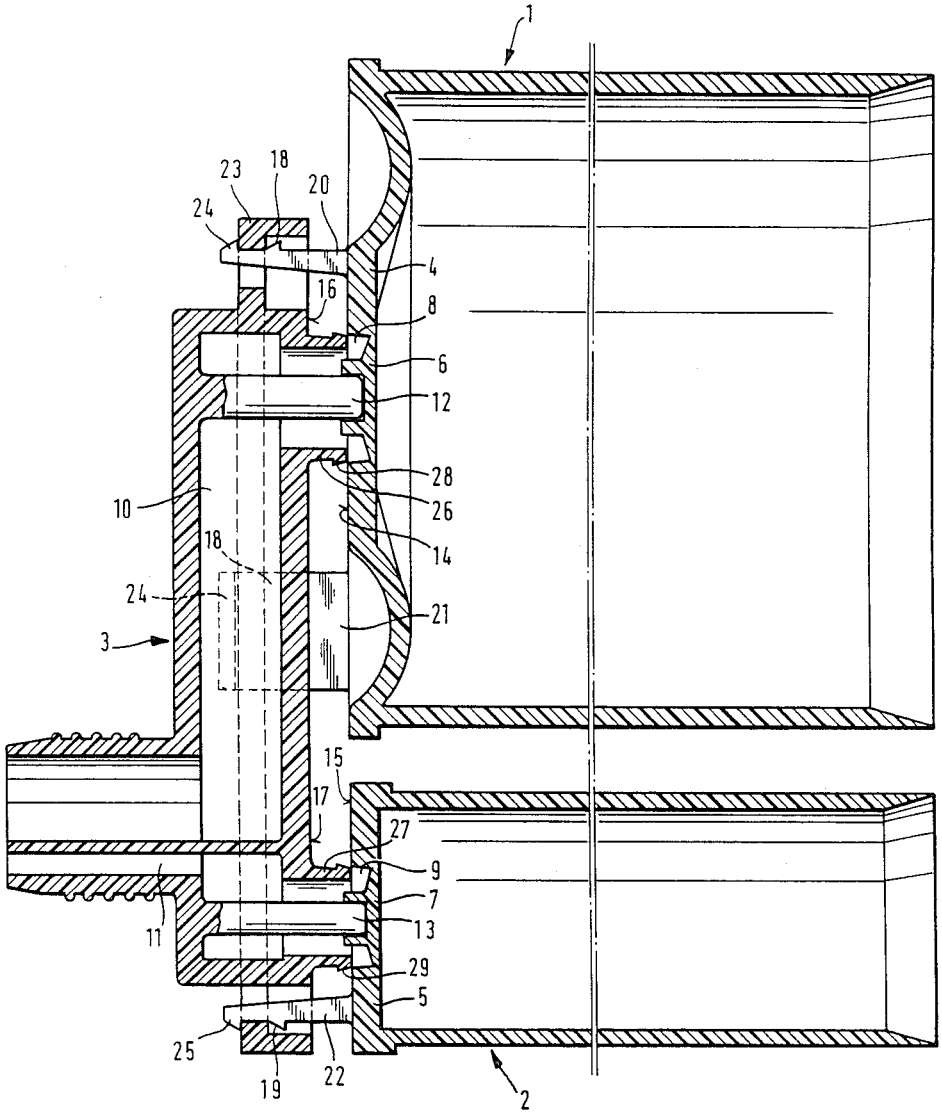
FIG. 1 is an axially extending cross-sectional view of a cartridge assembly embodying the present invention and including a discharge member and two containers arranged in the storage and transport condition.

In the drawing, a cartridge assembly is illustrated made up of two axially extending hollow cylindrically-shaped containers, 1, 2 and a discharge member 3 mounted on the ends of the containers. In the position in shown in FIG. 1, the containers and the discharge member can be moved axially relative to one another, while in FIG. 2 the relative movement has taken place.

The containers 1 and 2 are similarly constructed except they have different diameters. The difference in diameter is based on the mixing ratio of the different reaction components within the containers. The reaction components are in the form of flowable masses which can be pressed out of the containers.

Figure 2:
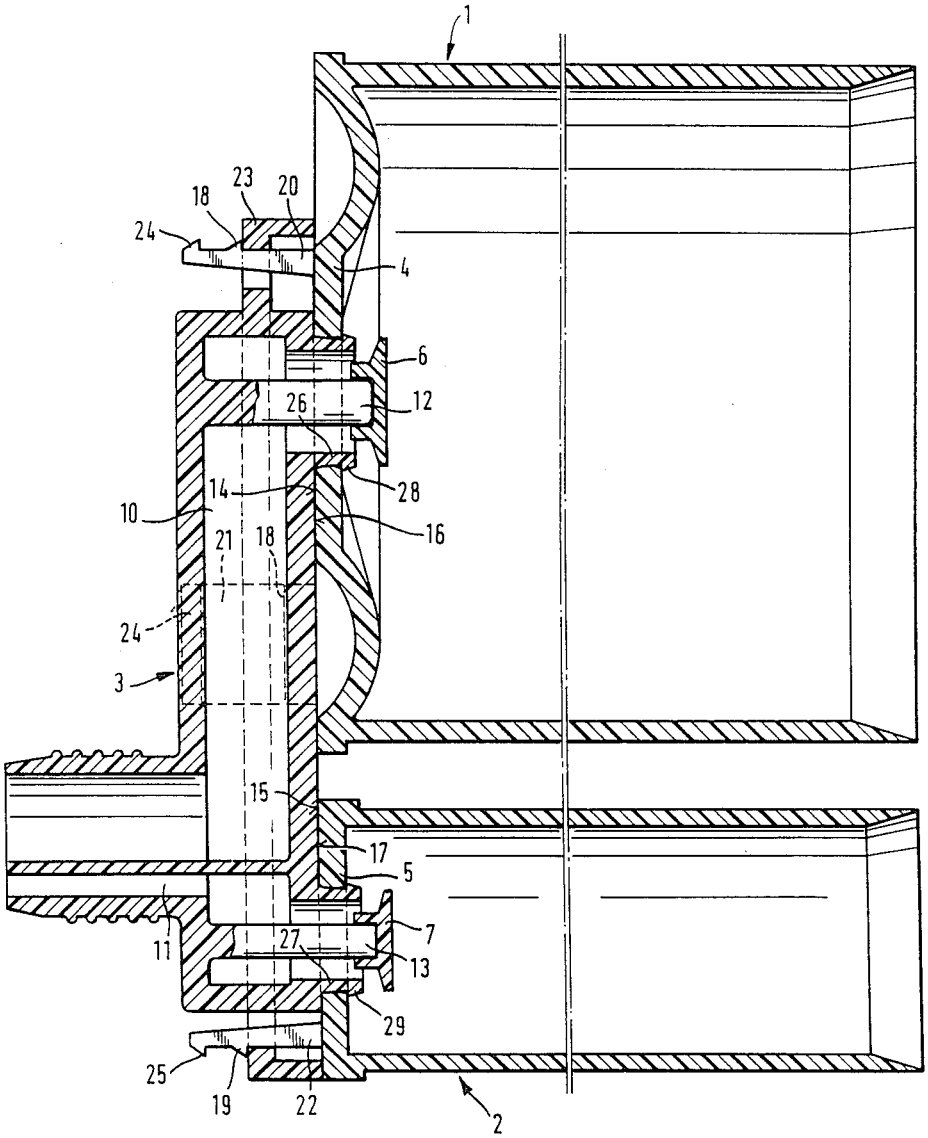
FIG. 2 is a view similar to FIG. 1, however, the discharge member and the containers have moved axially relative to one another with the containers in the open condition for dispensing the flowable masses.

As viewed in FIGS. 1 and 2, the first or left-hand ends of the containers 1 and 2 are closed and, after the containers are filled with the flowable masses, the second or right-hand ends are sealed with known pistons. Accordingly, the pistons are not illustrated. The first ends 4, 5 of the containers each have a centered removable closure 6, 7. Each closure 6, 7 is formed as a unitary part of the first end 4, 5 with the closures being secured to the remainder of the first end by annular weakened or reduced cross-section regions 8, 9.

The discharge member 3 has discharge conduits 10, 11 each corresponding to one of the containers 1, 2. The discharge member 3 has ejectors 12, 13 axially aligned with the removable closures 6, 7 in the first ends 4, 5 of the containers 1, 2. Note that the ejectors extend into recesses formed in the outside surfaces of the closures 6, 7. In the storage and transport condition shown in FIG. 1, the ejectors 23, 13 bear against the closures 6, 7 without displacing them. In this condition, the first ends 4, 5 of the containers have stop surfaces 14, 15 spaced from corresponding stop surfaces 16, 17 on the discharge member 3. When the containers 1, 2 are pressed toward the discharge member eliminating the spacing between the stop surfaces 14, 15–16, 17, the ejectors 12, 13 press the closures 6, 7 inwardly causing the closures to separate at the annular weakened sections 8, 9 whereby the closures are displaced out of the first ends 4, 5 into the position as shown in FIG. 2, with the stop surfaces bearing against one another.

As shown in FIG. 2, the removed or separated closures 6, 7 are retained on the ends of the ejectors 12, 13 to assure that the closures are not pressed back into the opening, so that a partial closing of the opening takes place.

Instead of the arrangement shown in FIG. 2, it is also possible by providing ejectors 12, 13 of a corresponding length so that the closures are completely displaced into the containers.

As shown in FIGS. 1 and 2, detent or interengaging means are provided on and interconnect the discharge member 3 on the front ends 4, 5 of the containers 1, 2. The detent means are in the form of detents 18, 19 located on generally axially extending fingers 20, 21, 22 of the containers 1, 2. Detents 18, 19 cooperate with a wall 23 forming part of the discharge member with the wall extending transversely of the axial direction of the containers. In FIG. 1, the discharge member 3 is held on the fingers 20, 21 and 22 so that its stop surfaces 16, 17 are in axially spaced relation to the stop surfaces 14, 15 on the containers. As is indicated in FIG. 2, the detents 18, 19 hold the discharge member against the first ends 4, 5 of the containers 1, 2 when the stop surfaces 14, 15–16, 17 are in contacting engagement. As shown in FIG. 1, detents 24, 25 spaced in the axial direction from the detents 18, 19 hold the discharge member in spaced relation to the ends 4, 5 of the containers 1, 2. In the condition shown in FIG. 1, the discharge member 3 and the containers 1, 2 are arranged for storage and transportation with the first ends 4, 5 of the containers being closed. When the discharge member is moved relative to the containers into the position or condition shown in FIG. 2, the closures have been displaced or separated from the remainder of the first ends, and the discharge member is held by the detents 18, 19 in contacting engagement with the adjacent first ends of the containers.

Furthermore, as shown in FIGS. 1 and 2, the discharge member 3 has tubular sections 26, 27 projecting from the stop surfaces 16, 17 toward the first ends 4, 5 of the containers 1, 2. The tubular sections are aligned with the weakened sections 8, 9 of the first ends 4, 5. When the discharge member 3 is displaced relative to the first ends 4, 5 of the containers 1, 2 into the position shown in FIG. 2, with the closures 6, 7 separated out of the first ends, the tubular section 26, 27 move through the openings formed by the separated closures and the angular detents 28, 29 on the ends of the tubular sections interengage with the inside surfaces of the first ends 4, 5, note FIG. 2 providing an additional connection of the discharge member to the containers and affording a seal preventing any flow of the masses within the containers between the discharge member and the first ends of the containers.

While specific embodiments of the invention have been shown and described in detail to illustrate the application of the inventive principles, it will be understood that the invention may be embodied otherwise without departing from such principles.

I claim:

1. A cartridge assembly for dispensing at least one flowable mass comprises at least one axially extending hollow cylindrically shaped container having a first end and a second end spaced apart in the axial direction, and a discharge member having a discharge conduit for dispensing the flowable mass out of said container, wherein the improvement comprises said container and discharge member are separable parts with said discharge member mounted on the first end of said container and being displaceable in the axial direction of said container from a first position for storage and transport of said cartridge assembly to a second position for dispensing the flowable mass, said discharge member and said container having cooperating stop means thereon for limiting the displacement of said discharge member and said container into the second position, said container having a closure in the first end thereof, said closure is displaceable by an ejector on said discharge member for forming an opening when said discharge member and container are in the second position for dispensing the flowable mass out of the container, cooperating detent means are formed on said discharge member and container for interconnecting the discharge member and the container in the first and second positions, said detent means includes a tubular section formed on the stop surface of said discharge member and projecting therefrom in the first position toward said first end of said container and, when said closure is displaced, said tubular section extends through the opening left by said closure.

2. Cartridge assembly, as set forth in claim 1, wherein said closure is disposed in the center of said first end of said container, and said ejector extends in the axial direction of said container toward the first end of said container for displacing said closure when said discharge member is in the second position.

3. Cartridge assembly, as set forth in claim 1, wherein said first end of said container has a annular reduced cross-section weakened section encircling said closure for affording a predetermined separation line for separating said closure out of said first end of said container and forming an opening therethrough.

4. Cartridge assembly, as set forth in claim 3, wherein said ejector is elongated and extends in the axial direction of said container and projects from said discharge member toward the first end of said container and is arranged to engage and displace said closure out of the first end of said container when said discharge member and container are moved into the second position.

5. Cartridge assembly, as set forth in claim 4, wherein said ejector contacts said closure when said discharge member and container are in the first position.

6. Cartridge assembly, as set forth in claim 1, wherein said stop means on said discharge member and container are facing stop surfaces extending transversely of the axial direction of said container and arranged to be in spaced relationship in the first position and to be in surface contacting engagement in the second position for forming sealing surfaces between the discharge member and container.

7. Cartridge assembly, as set forth in claim 3, wherein the outside diameter of said tubular section corresponds approximately to the outside diameter of the annular weakened section, in said first end of said container.

8. Cartridge assembly, as set forth in claim 1, wherein said cartridge assembly includes at least two said containers in axially parallel relation and said discharge member having a discharge conduit for each said container.

* * * * *